US005771870A

United States Patent [19]

Satou et al.

[11] Patent Number: 5,771,870

[45] Date of Patent: Jun. 30, 1998

[54] IGNITION COIL FOR AN INTERNAL COMBUSTION ENGINE

[75] Inventors: Yoshitaka Satou, Toyohashi; Kazutoyo Oosuka, Gamagoori; Masami Kojima, Chiryu; Yoshihiro Shimoide, Tokai, all of Japan

[73] Assignee: Denso Corporation, Kariya, Japan

[21] Appl. No.: 761,827

[22] Filed: Dec. 6, 1996

[30] Foreign Application Priority Data

Dec. 6, 1995 [JP] Japan ..... 7-317680

[51] Int. Cl.[6] ..... F02P 15/00

[52] U.S. Cl. ..... 123/635; 123/169 PA

[58] Field of Search ..... 123/634, 635, 123/143 C, 169 PA, 647; 277/71, 75, 201

[56] References Cited

U.S. PATENT DOCUMENTS 4,514,712 4/1985 McDoggal ..... 336/96
4,944,259 7/1990 Richardson ..... 123/169 PA
5,462,023 10/1995 Furuya ..... 123/143 C
5,492,105 2/1996 Nakajima et al. ..... 123/635
5,537,983 7/1996 Nakajima ..... 123/635

FOREIGN PATENT DOCUMENTS 6-58237 3/1994 Japan .
6-52123 7/1994 Japan .
8-49640 2/1996 Japan .

*Primary Examiner*—Willis R. Wolfe
*Assistant Examiner*—Hieu T. Vo
*Attorney, Agent, or Firm*—Cushman, Darby & Cushman IP Group of Pillsbury, Madison & Sutro LLP

[57] ABSTRACT

An ignition coil for an internal combustion engine, having a seal between the ignition coil and a plug hole of the engine. An air passage is provided only on a head portion and a pipe portion of the ignition coil to permit air to pass. Pressure change in the plug hole can be equalized with the atmosphere through the air passage. Therefore, it becomes easy to make the seal and to attach the seal to the ignition coil because the seal does not have any air passage.

11 Claims, 9 Drawing Sheets

IGNITION COIL FOR AN INTERNAL COMBUSTION ENGINE

CROSS REFERENCE TO RELATED APPLICATION

This application is based upon and claims priority from Japanese Patent Application No. Hei 7-317680 filed Dec. 6, 1995, the contents of which are incorporated herein by reference.

BACKGROUND OF THE INVENTION

1. Field of the Invention

The present invention relates to an ignition coil for an internal combustion engine.

2. Description of Related Art

One type of known ignition coil for an internal combustion engine is separately provided for each spark plug. Each spark plug is inserted in the bottom of a plug hole in the engine cover. The corresponding ignition coil has a casing containing the coil. Each casing is positioned in the corresponding plug hole. A high voltage generated by each ignition coil is supplied to a terminal of the corresponding spark plug and produces a spark discharge between electrodes of the spark plug in a combustion chamber of the engine.

The seal between the casing and the plug hole should be waterproof to prevent water, etc., from leaking into the plug hole. On the other hand, the seal should also permit air to pass so that volume changes of the air in the plug hole will not produce pressure changes.

For example, JP-A-6-58237 and JP-A-6-52123 each disclose an ignition coil for an internal combustion engine having a waterproof seal which lets air pass by forming a connecting passage that extends through both the seal and casing to connect the plug hole to the atmosphere.

The shape of such connecting passage of the ignition coil disclosed in JP-A-6-58237 and JP-A-6-52123 is complicated, because the connecting passage is formed through both the seal and the casing which requires these two structures to be aligned. Therefore, the structure of a die for the casing becomes complicated and the manufacturing cost of the casing rises. Further, the complexity of the shape of the seal also causes the manufacturing cost to rise.

SUMMARY OF THE INVENTION

The present invention is made in light of the foregoing problem, and it is an object of the present invention to provide an ignition coil having a simple structure with a watertight seal which can also let air pass.

According to the ignition coil for an internal combustion engine of the present invention, when water or the like falls on the ignition coil, a seal between a head portion of the ignition coil and the engine can prevent water or the like from entering a plug hole. When the pressure in the plug hole changes, such change can be equalized with the atmosphere through a head passage, which is provided on the head portion, and a gap which is provided between the seal and an outer periphery of a pipe portion in the plug hole. Therefore, it becomes easy to make the seal because the seal does not have any air passage. Furthermore, it becomes easy to attach the seal to the ignition coil because the seal does not have any air passage.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiments of the present invention will be described hereinafter with reference to the drawings.

(First embodiment)

Figure 1:
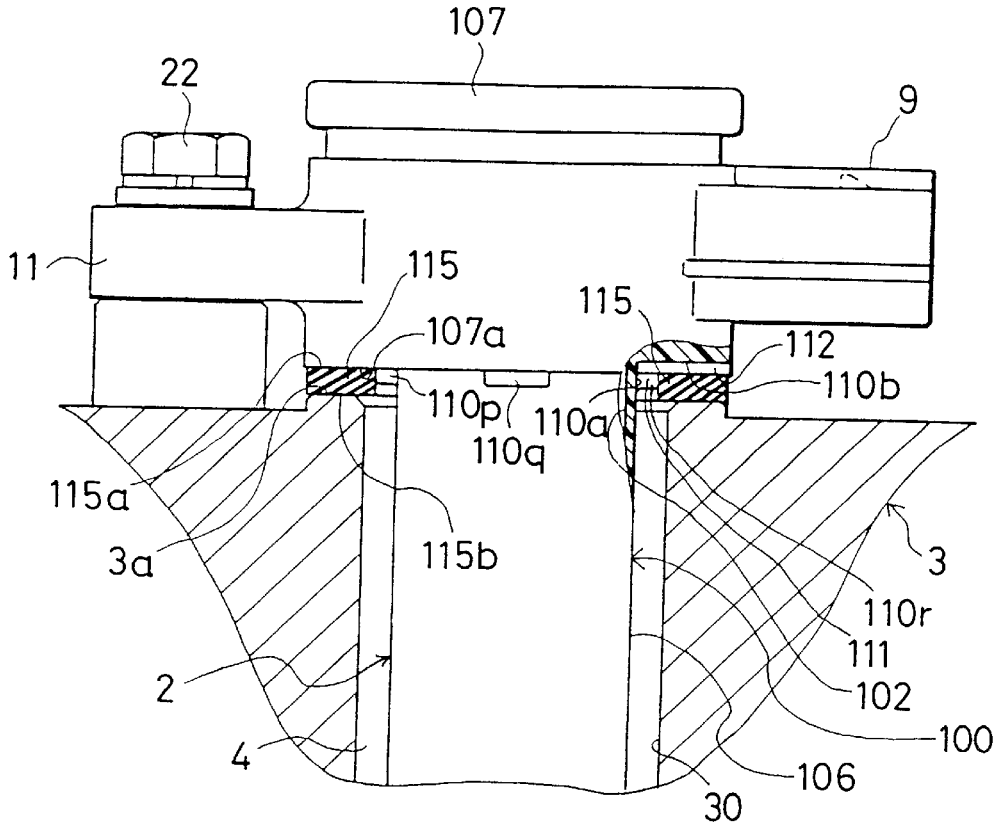
FIG. 1 is a partially sectional view of an ignition coil according to a first embodiment of the present invention.
Figure 2:
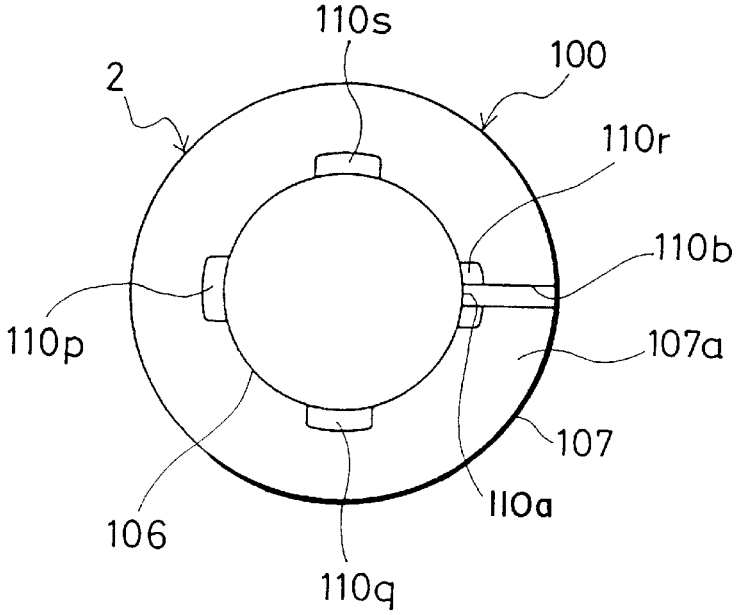
FIG. 2 is a partial schematic bottom plan view of the embodiment in FIG. 1.

A first embodiment of the present invention is shown in FIG. 1 and FIG. 2.

As shown in FIG. 1, a plug hole 4 is formed by a recess 30 on a head cover 3 of an engine corresponding to each cylinder. An ignition coil 2 is positioned in the recess 30 with a packing 115. A spark plug (not shown) which extends into a combustion chamber (not shown) is inserted in the bottom of the recess 30.

The ignition coil 2 includes a casing 100 integrally made of resin material. The casing 100 generally has a tubular shape and includes a pipe portion 106 and a head portion 107. The pipe portion 106 forms a space 102 for a transformer (not shown) which functions as a coil. The head portion 107 generally has a tubular shape whose diameter is greater than that of the pipe portion 106 and is formed on the upper edge of the pipe portion 106 on the same axis as the pipe portion 106. A connecting portion (not shown) is provided at the lower edge of the pipe portion 106, and a secondary voltage of the transformer is supplied from the connecting portion to the spark plug. The pipe portion 106 is placed in the plug hole 4. The head portion 107 is placed to cover an opening of the plug hole.

A control circuit (not shown) which intermittently conducts primary current through the transformer is placed in the head portion 107. A control signal is input to the control circuit through connector 9 which is integrally molded with the head portion 107. A fixation bracket 11 is integrally molded with the head portion 107 at an opposite side of the connector 9 along the radial direction of the head portion 107. The ignition coil 2 is fixed to the head cover 3 of the engine by a bolt 22 which extends through the fixation bracket 11.

Protrusions 110*p*, 110*q*, 110*r* and 110*s* are formed on an edge of the pipe portion 106 at the side of the head portion 107. The protrusions 110*p*, 110*q*, 110*r*, 110*s* extend outwardly in radial directions from an outer wall of the pipe portion 106, and are spaced evenly around the pipe portion 106. The protrusion 110*r* is placed beneath the connector 9 and the protrusion 110*p* is placed beneath the fixation bracket 11. An axial groove 110*a*, which divides the protrusion 110*r* at its center, is formed on the protrusion 110*r* along the axial direction of the pipe portion 106. A radial groove 110*b*, which connects the axial groove 110*a* to an opening of an outer wall of the head portion 107 beneath the connector 9, is formed on a lower surface 107*a* of the head portion 107 along the radial direction of the head portion 107. Both the axial groove 110*a* and the radial groove 110*b* are integrally molded with the casing 100 by resin simultaneously.

Locations of the axial groove 110*a*, the radial groove 110*b* and the protrusion 110*r* are shown in FIG. 2. In FIG. 2, the connector 9, the fixation bracket 11 and a packing 115 are omitted. The purpose of providing the protrusions 110*p*, 110*q*, 110*r* and 110*s* is to form a space between the outer wall of the pipe portion 106 and an inner wall of the packing 115 which is attached to the outside of the protrusions 110*p*, 110*q*, 110*r* and 110*s*.

As shown in FIG. 1, the rubber packing 115, which has a ring shape, is attached to the outside of the protrusions 110*p*, 110*q*, 110*r* and 110*s*. The outer diameter of the packing 115 is approximately the same as that of the head portion 107. The length of the packing 115 in the axial direction is longer than the length of the protrusions 110*p*, 110*q*, 110*r* and 110*s* in the axial direction. Although the outside edges of the protrusions 110*p*, 110*q*, 110*r* and 110*s* firmly contact the inner wall of the packing 115, a first gap 111 is formed between the axial groove 110*a* and the inner wall of the packing 115 because the axial groove 110*a* is formed on the protrusion 110*r*. Although the lower surface 107*a* of the head portion 107 firmly contacts with the upper surface 115*a* of the packing 115, a head passage 112 which is connected to the first gap 111 is formed between the radial groove 110*b* and the upper surface 115*a* because the radial groove 110*b* is formed on the lower surface 107*a*.

When the pipe portion 106 is inserted in the plug hole 4, a lower surface 115*b* of the packing 115 contacts with a ring-shaped protrusion 3*a* which is provided around the recess 30 of the head cover 3 of the engine. The seal between the casing 100 and the head cover 3 of the engine is made by pressing the packing 115 in the axial direction between the ring-shaped protrusion 3*a* and the lower surface 107*a* of the head portion 107 by the clamping power of the bolt 22. The plug hole 4 is connected to the space in the engine compartment beneath the connector 9 through a connecting passage which comprises the first gap 111 and the head passage 112 because the first gap 111 is connected to the plug hole 4. Therefore, the plug hole 4 is connected to the atmosphere.

According to the first embodiment of the present invention, the manufacture of the packing 115 is easy because the packing 115 has a simple ring shape. The connecting passage which connects the plug hole 4 to the space in the engine compartment is formed between the casing 100 and the packing 115 by attaching the packing 115 to the casing 100 which has the axial groove 110*a* and the radial groove 110*b*. There is no need to arrange the positioning of the casing 100 and the packing 115 in the circumferential direction because both the axial groove 110*a* and the radial groove 110*b* are formed only on the casing 100. Therefore, the assembly of the ignition coil 2 becomes easy. Furthermore, the manufacture of the casing 100 is also easy because the axial groove 110*a* and the radial groove 110*b* have the shape of a simple straight line and are formed simultaneously when the casing 100 is made by resin molding. The head passage 112 has an opening to the space of the engine compartment beneath the connector 9 which protrudes from the head portion 107 in the radial direction. Therefore, if water or the like falls on the head cover 3 of the engine, it is difficult for water to get in the plug hole 4 through the head passage 112 because the connector 9 blocks water.

In the first embodiment, it might be possible to form the opening of the head passage 112 beneath the fixation bracket 11 instead of the connector 9. In this case, the fixation bracket 11 blocks water. Furthermore, it might be possible to form a plurality of connecting passages which connect the plug hole 4 to the space of the engine compartment. Furthermore, it might be possible to form the radial groove 110*b* on the lower surface 107*a* other than at the protrusions 110*p*, 110*q*, 110*r* and 110*s* and omit the axial groove 110*a*. In this case, the head passage formed between the radial groove and the packing 115 is connected to the plug hole 4 through a circular gap, corresponding to the first gap 111, which is formed between one protrusion and another protrusion among the protrusions 110*p*, 110*q*, 110*r* and 110*s*.

(Second embodiment)

Figure 3:
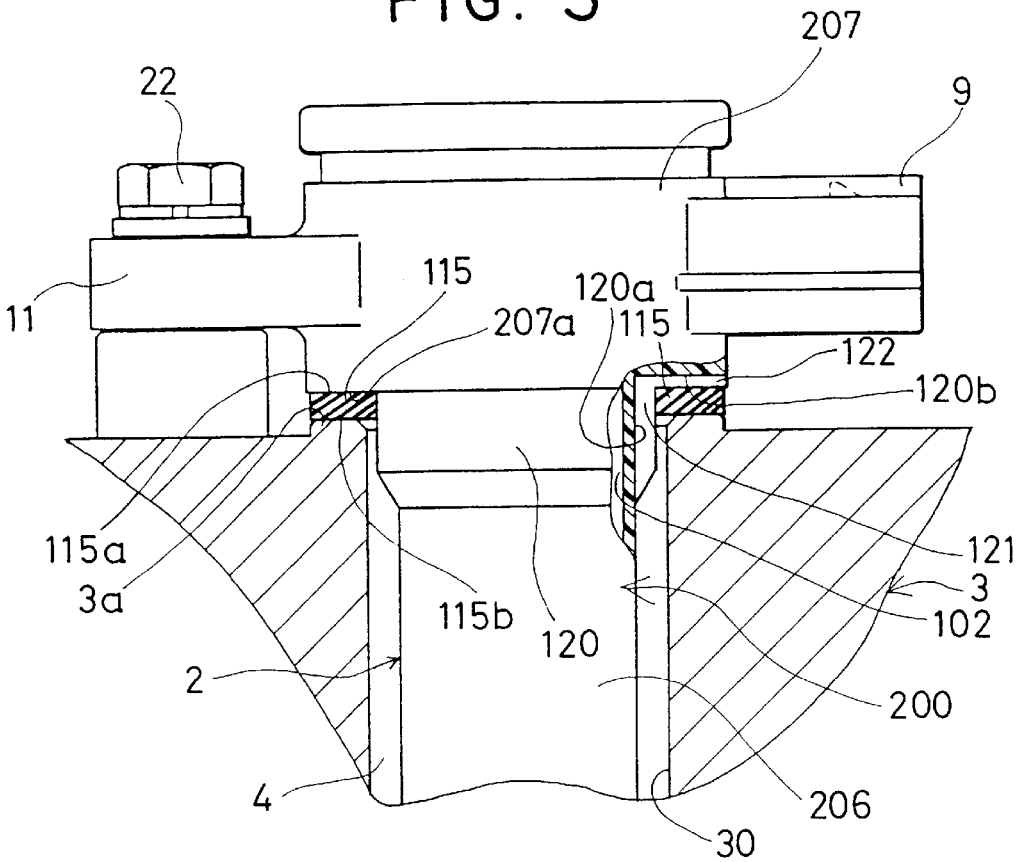
FIG. 3 is a partially sectional view of an ignition coil according to a second embodiment of the present invention.
Figure 4:
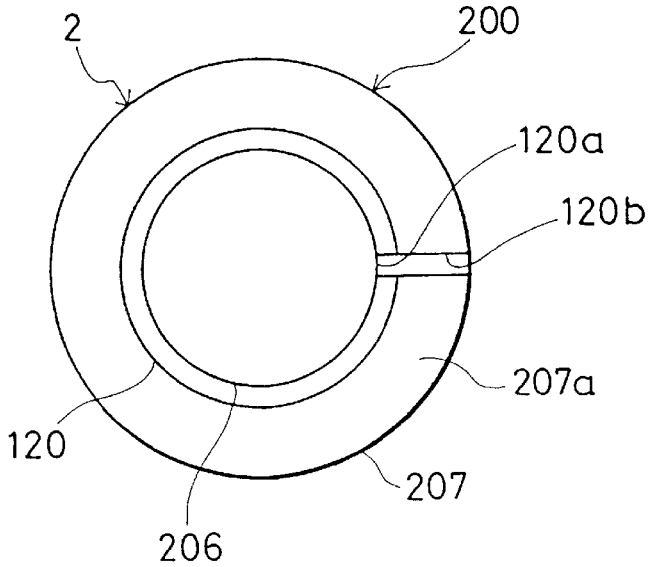
FIG. 4 is a partial schematic bottom plan view of the embodiment in FIG. 3.

A second embodiment of the present invention is shown in FIGS. 3 and 4. In this and the following embodiments, components which are substantially the same to each other are assigned the same reference numerals. In the second embodiment, a radially larger portion 120 is formed instead of the protrusions 110*p*, 110*q*, 110*r* and 110*s*.

As shown in FIG. 3, the radially larger portion 120, which generally has a cylindrical shape, is formed at the edge of pipe portion 206 at the side of a head portion 207. An axial groove 120*a*, which is continuous from the lower edge of the radially larger portion 120 to the connecting portion between the head portion 207 and the radially larger portion 120 along the axial direction of the pipe portion 206, is formed on the radially larger portion 120 beneath the connector 9. A radial groove 120*b*, which connects the axial groove 120*a* to an opening of an outer wall of the head portion 207 beneath the connector 9, is formed on a lower surface 207*a* of the head portion 207 along the radial direction of the head portion 207. Both the axial groove 120*a* and the radial groove 120*b* are integrally molded with a casing 200 by resin simultaneously.

Locations of the radially larger portion 120, the axial groove 120*a* and the radial groove 120*b* are shown in FIG. 4. In FIG. 4, the connector 9, the fixation bracket 11 and a packing 115 are omitted.

When the packing 115, which has a ring shape, is attached to the outside of the radially larger portion 120, the outside wall of the radially larger portion 120 firmly contacts the inner wall of the packing 115. A first gap 121 is formed between the axial groove 120*a* and the inner wall of the packing 115 because the axial groove 120*a* is formed beneath the connector 9. Although the lower surface 207*a* of the head portion 207 firmly contacts with the upper surface

115*a* of the packing 115, a head passage 122 which is connected to the first gap 121 is formed between the radial groove 120*b* and the upper surface 115*a* because the radial groove 120*b* is formed on the lower surface 207*a*.

When the pipe portion 206 is inserted in the plug hole 4, the plug hole 4 is connected to the space in the engine compartment beneath the connector 9 through a connecting passage which comprises the first gap 121 and the head passage 122 because the first gap 121 is connected to the plug hole 4.

According to the second embodiment of the present invention, in addition to the same effects and advantages as in the first embodiment, positioning accuracy of the packing 115 in the radial direction is improved because the packing 115 fits the outer periphery of the radially larger portion 120 and is prevented from being deformed in the radial direction. Therefore, the sealing performance between the casing 200 and the head cover 3 of the engine can be improved because any decrease in the seal length caused by the shifting of the packing 115 can be prevented. Furthermore, the shape of the packing 115 can be stable when the packing 115 is compressed in the axial direction between the ring-shaped protrusion 3*a* and the lower surface 207*a* of the head portion 207 by the clamping power of the bolt 22 because the deformation of the packing 115 toward the center in the radial direction is prevented by the outer wall of the radially larger portion 120. Furthermore, compared to the first embodiment, it may be easier to attach the packing 115 to the larger portion 120 in the second embodiment because the packing 115 can be attached to the radially larger portion 120 only by inserting the radially larger portion 120 into the packing 115 in the second embodiment while the packing 115 should be attached to the outside of the four protrusions 110*p*, 110*q*, 110*r* and 110*s* in the first embodiment.

(Third embodiment)

Figure 5:
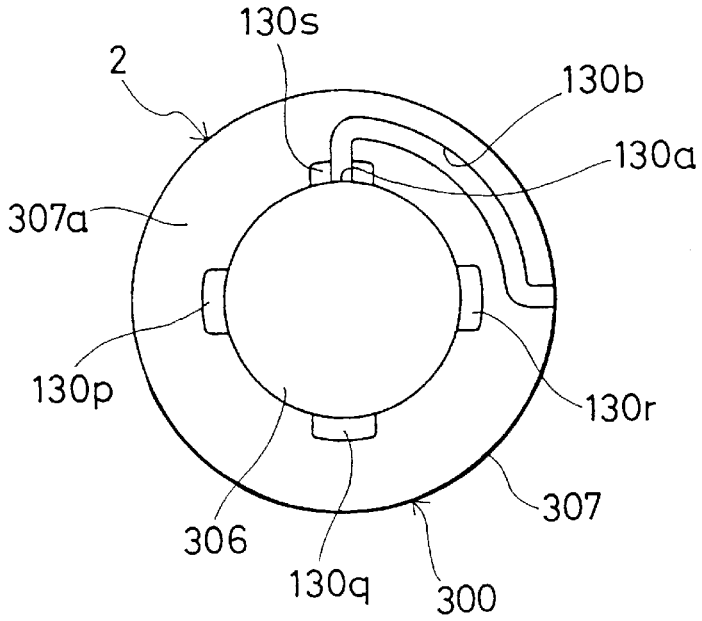
FIG. 5 is a partial schematic bottom plan view of an ignition coil according to a third embodiment of the present invention.

A third embodiment of the present invention is shown in FIG. 5. This embodiment differs with respect to the shape of the radial groove 110*b* which is a part of the head passage 112 in the first embodiment.

In FIG. 5, the connector 9, the fixation bracket 11 and the packing 115 are omitted.

Protrusions 130*p*, 130*q*, 130*r* and 130*s* are formed on an edge of a pipe portion 306 at the side of a head portion 307. The protrusions 130*p*, 130*q*, 130*r* and 130*s* extend in radial directions from the outer wall of the pipe portion 306, and are spaced evenly around the pipe portion 306. The protrusion 130*r* is placed beneath the connector 9 and the protrusion 130*p* is placed beneath the fixation bracket 11. An axial groove 130*a*, which divides the protrusion 130*s* at its center, is formed on the protrusion 130*s* along the axial direction of the pipe portion 306. A radial groove 130*b*, which connects the axial groove 130*a* to an opening of an outer wall of the head portion 307 beneath the connector 9, is formed on a lower surface 307*a* of the head portion 307. Both the axial groove 130*a* and the radial groove 130*b* are integrally resin molded with a casing 300.

When the packing 115, which has a ring shape, is attached to the outside of the protrusions 130*p*, 130*q*, 130*r* and 130*s*, a first gap is formed between the axial groove 130*a* and the inner wall of the packing 115 and a head passage which is connected to the first gap is formed between the radial groove 130*b* and the upper surface 115*a* of the packing 115.

When the pipe portion 306 is inserted in the plug hole 4, the plug hole 4 is connected to the space in the engine compartment beneath the connector 9 through a connecting passage which comprises the first gap and the head passage because the first gap is connected to the plug hole 4.

According to the third embodiment of the present invention, in addition to the same effects and advantages as the first embodiment, there is an advantage that it becomes more difficult for water to get in the plug hole 4 through the head passage because the radial groove 130*b* in the third embodiment is longer than the radial groove 110*b* in the first embodiment. That is, the head passage in the third embodiment is longer than the head passage 112 in the first embodiment.

In the first through third embodiments, it may be possible to increase the thickness of the packing 115 in the axial direction. According to such modification, the connecting passage and the space of the engine compartment are connected at a higher position. That is, the distance between the opening of the head passage and the head cover 3 of the engine becomes longer. Therefore, it becomes more difficult for water to get in the plug hole 4 through the head passage when water or the like falls on the head cover 3 of the engine.

(Fourth embodiment)

Figure 6:
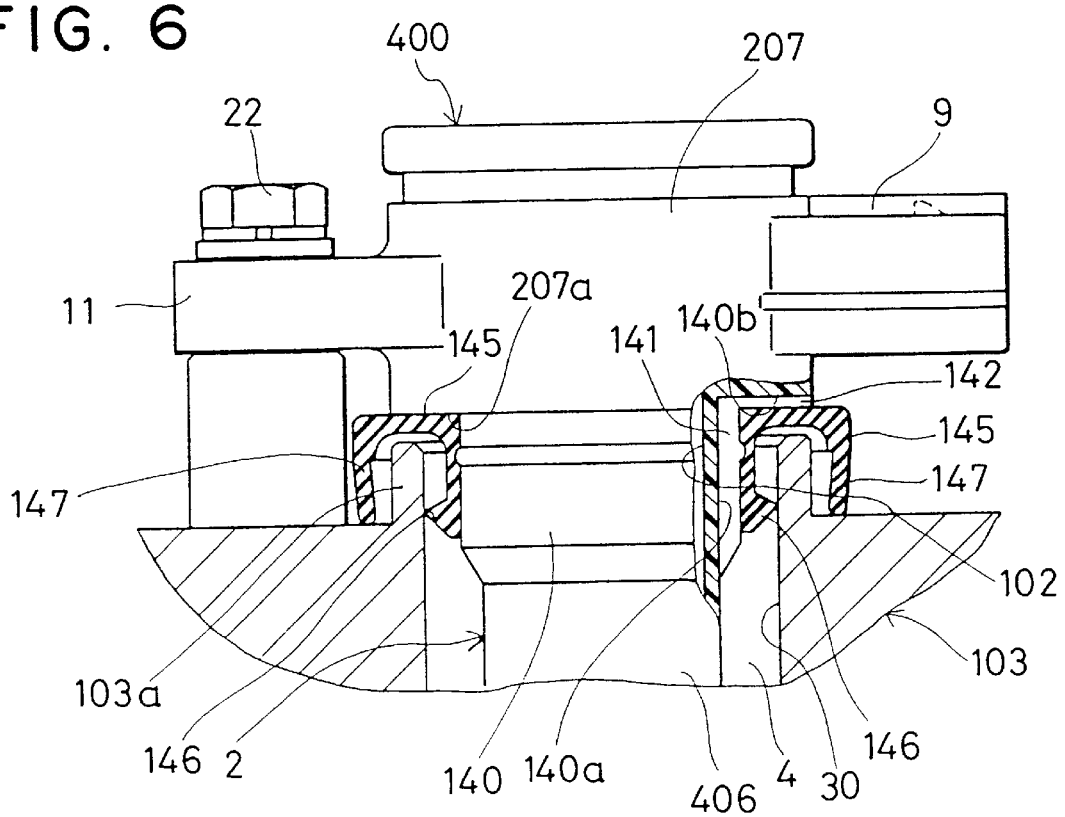
FIG. 6 is a partially sectional view of an ignition coil according to a fourth embodiment of the present invention.

A fourth embodiment of the present invention is shown in FIG. 6. The difference between the second embodiment and the fourth embodiment is the structure of the packing.

A radially larger portion 140, which generally has a cylindrical shape, is formed at the edge of a pipe portion 406 at the side of the head portion 207. An axial groove 140*a*, which is continuous from the lower edge of the radially larger portion 140 to the connecting portion between the head portion 207 and the radially larger portion 140 along the axial direction of the pipe portion 406, is formed on the radially larger portion 140 beneath the connector 9. A radial groove 140*b*, which connects the axial groove 140*a* to an opening of an outer wall of the head portion 207 beneath the connector 9, is formed on a lower surface 207*a* of the head portion 207 along the radial direction of the head portion 207. Both the axial groove 140*a* and the radial groove 140*b* are integrally molded with a casing 400 by resin simultaneously.

A ring-shaped packing 145, whose cross section defines a downwardly opening recess, is attached to an outer periphery of the radially larger portion 140. A first gap 141 is formed between the axial groove 140*a* and the inner wall of the packing 145 and a head passage 142, which is connected to the first gap 141, is formed between the radial groove 140*b* and the upper surface of the packing 145. A circular thick seal portion 146 is formed at an inner edge of the seal 145. The thickness of the thick seal portion 146 in the radial direction is thicker than a gap formed between the outer wall of the radially larger portion 140 and the inner wall of the recess 30. A circular flange seal portion 147, which lies between the lower surface 207*a* of the head portion 207 and a head cover 103 of the engine, is formed at an outer edge of the seal 145.

A cylindrical protrusion 103*a* is formed on the head cover 103 of the engine in such a manner that the cylindrical protrusion 103*a* surrounds the recess 30. The thick seal portion 146 is positioned at the inside of the cylindrical protrusion 103*a* and the flange seal portion 147 is positioned at the outside of the cylindrical protrusion 103*a*. A seal in the radial direction between the outer wall of the radially larger portion 140 and the inner wall of the recess 30 is made by the thick seal portion 146. A seal in the axial direction between the lower surface 207*a* and the head cover 103 of the engine is made by the flange seal portion 147. The plug hole 4 is connected to the space in the engine compartment beneath the connector 9 through a connecting passage which comprises the first gap 141 and the head passage 142 because the first gap 141 is connected to the plug hole 4.

According to the fourth embodiment of the present invention, in addition to the same effects and advantages as the second embodiment, there is an advantage that it becomes easy to set the strength of the clamping power of the bolt 22 because the seal in the radial and the axial directions are made in the fourth embodiment while the seal is made only in the axial direction in the first through third embodiments. In other words, the radial seal can prevent water, etc., from entering plug hole 4 even if the axial seal is insufficient as a result of insufficient or excessive clamping power of the bolt 22.

(Fifth embodiment)

A fifth embodiment of the present invention is shown in FIGS. 7, 8, 9, 13 and 14. The difference between the first embodiment and the fifth embodiment is the structure of the head passage.

Figure 7:
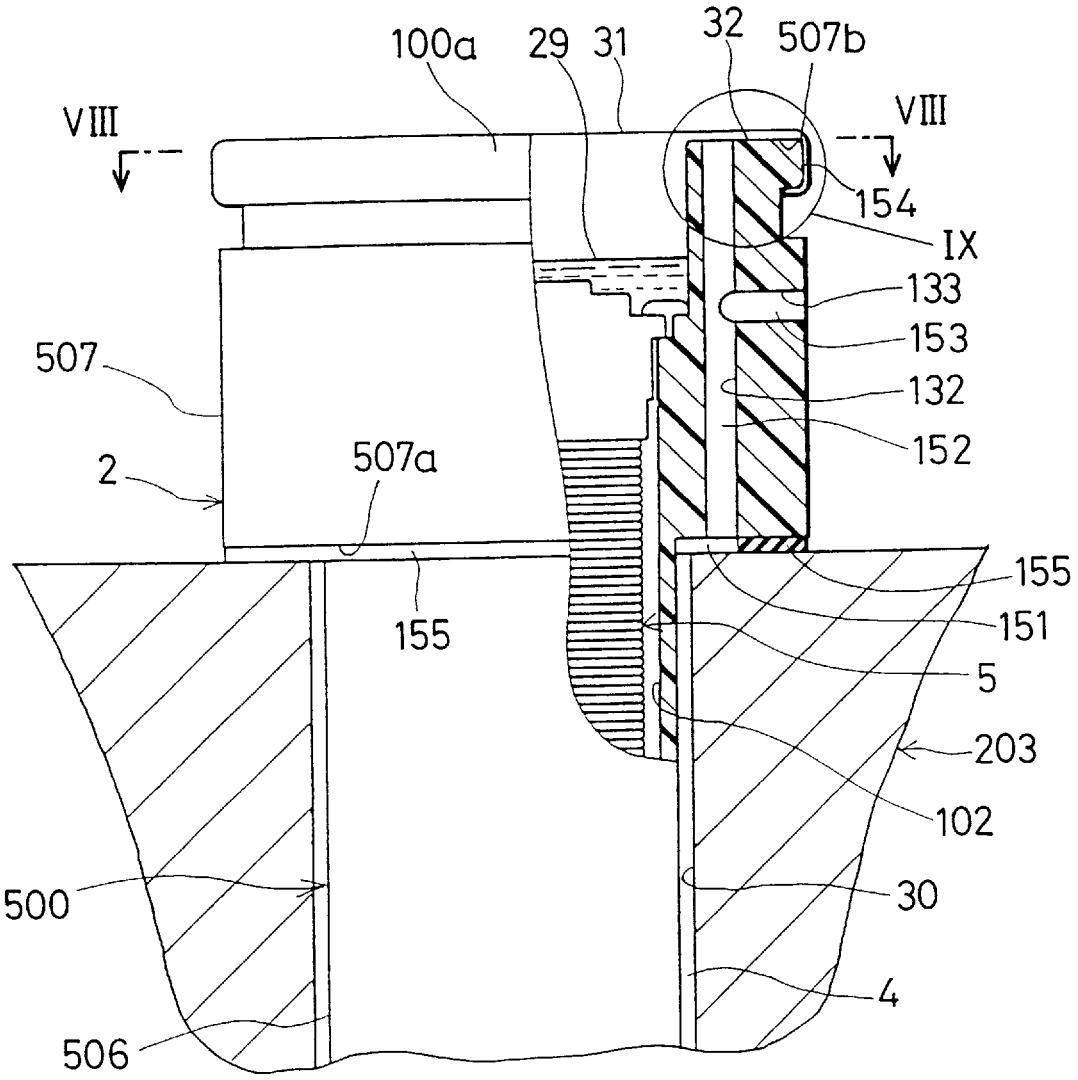
FIG. 7 is a partially sectional view of an ignition coil according to a fifth embodiment of the present invention.
Figure 8:
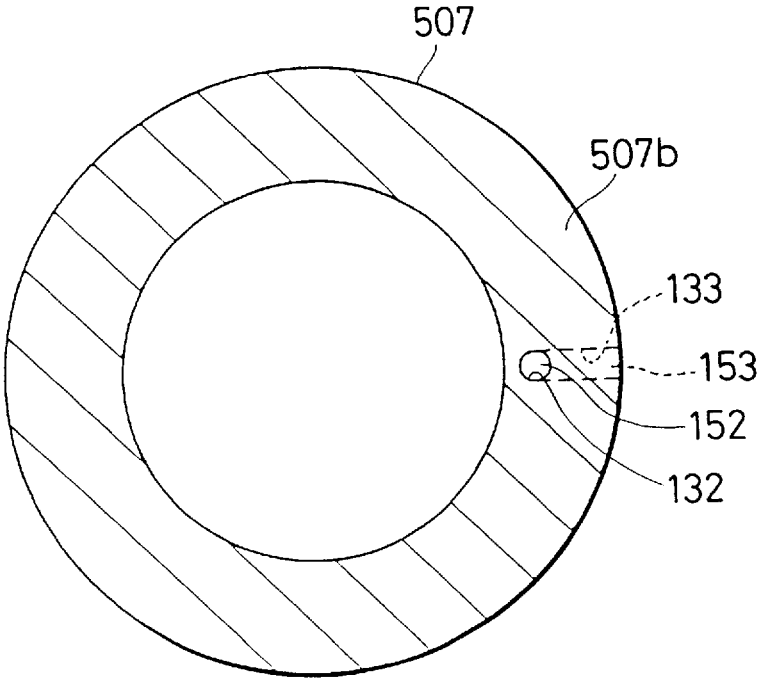
FIG. 8 is a schematic cross sectional view taken along the line VIII—VIII of FIG. 7.
Figure 9:
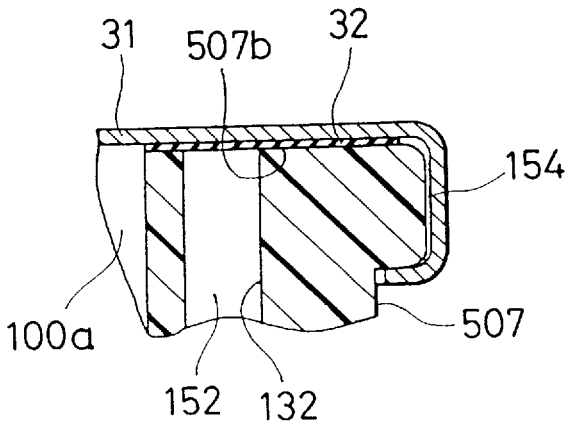
FIG. 9 is an enlarged partially sectional view of a portion IX of FIG. 7.

As shown in FIG. 7, a transformer 5 and an insulating oil 29 which surrounds the transformer 5 are placed in a space 102 defined by a pipe portion 506 through an opening 100*a* provided on a head portion 507. The opening 100*a* is closed by a metal cap 31 by curling and caulking the edge of the cap 31 on a top periphery of the head portion 507. Furthermore, as shown in FIG. 9, a second gap 154 which has a ring shape is formed between the cap 31 and the top periphery of the head portion 507. There is also some small gaps (not shown) between the edge of the cap 31 and the head portion 507 because the edge of the cap 31 has wrinkles caused when the edge of the metal cap 31 is curled and caulked on the head portion. Therefore, the second gap 154 is connected to the space of the engine compartment through the small gaps formed by the wrinkles.

As shown in FIG. 7, a ring-shaped gap is formed between the upper surface of the head cover 203 of the engine and a lower surface 507*a* of the head portion 507. The outer periphery of the ring-shaped gap is sealed by the ring-shaped packing 155, and a ring-shaped first gap 151 is formed at the inside of the packing 155. The first gap 151 is connected to the plug hole 4.

A head passage is defined on the head portion 507 by forming an axial hole 132 and a radial hole 133. The axial hole 132 is formed, connecting a lower surface 507*a* at the inside of the packing 155 to an upper surface 507*b* of the head portion 507, along the axial direction of the pipe portion 506 and the head portion 507. The radial hole 133 is formed, connecting the axial hole 132 to an opening of the outer wall of the head portion 507, along the radial direction of the head portion 507 at a little higher than the center of the height of the head portion 507. An axial passage 152, which is connected to the first gap 151, is defined by the axial hole 132. As shown in FIG. 9, an opening of the axial hole 132 is sealed by a seal 32 in order to prevent water, dust and the like from entering to the opening 100*a* from the axial passage 152. A radial passage 153, which connects the axial passage 152 to the space of the engine compartment, is defined by the radial hole 133. Therefore, the plug hole 4 is connected to the space of the engine compartment through a connecting passage which consists of the first gap 151, the axial passage 152 and the radial passage 153.

According to the fifth embodiment of the present invention, in addition to the same effects and advantages as the second embodiment, there is an advantage that it becomes difficult for water to enter into the plug hole 4 through the connecting passage which consists of the first gap 151, the axial passage 152 and the radial passage 153 when water falls on the head cover 203 of the engine, because the connecting passage can be formed at higher position than the upper surface of the head cover 203. It is desirable to form the radial passage 153 as high above the upper surface of the head cover 203 as possible.

The opening of the radial passage 153 can be located in the connector 9 in FIG. 1. According to this modification, the opening of the radial passage 153 is not exposed to the outside of the connector 9 because a female connector (not shown) is connected to the connector 9 when the ignition coil 2 is under use. Therefore, it is even more certain that water is shut out from the opening of the radial passage 153.

Figure 13:
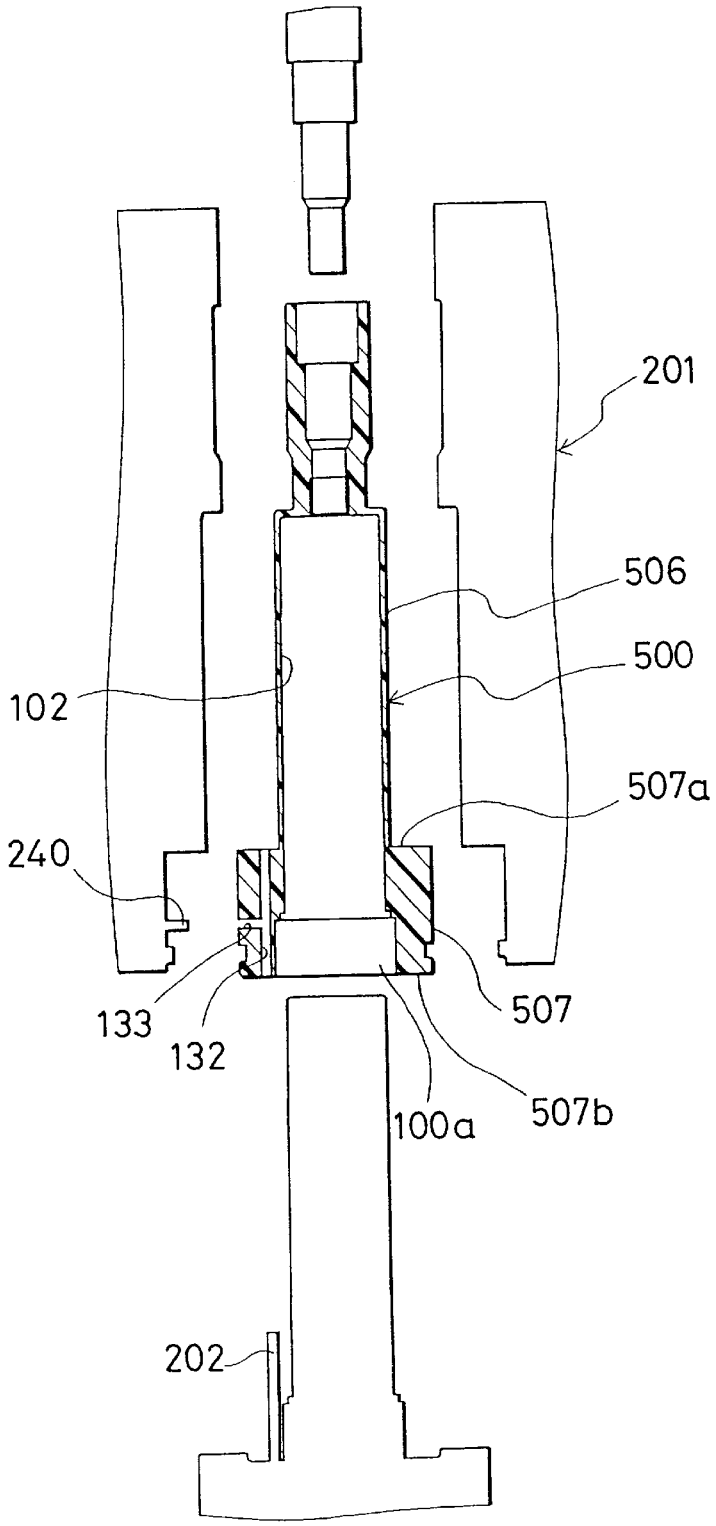
FIG. 13 is a partially sectional view of a first embodiment of a die for molding a casing of the ignition coil in the fifth embodiment of the present invention.

One example of a die 201 for molding the casing 500 in the fifth embodiment is shown in FIG. 13. The axial hole 132 is formed by a stick portion 202 provided on a die 201. The radial hole 133 is formed by a stick portion 240 provided on a die 201. The axial hole 132 and the radial hole 133 can be formed while molding the casing 500 by using simple die 201 because both the axial hole and the radial hole are straight holes.

Figure 14:
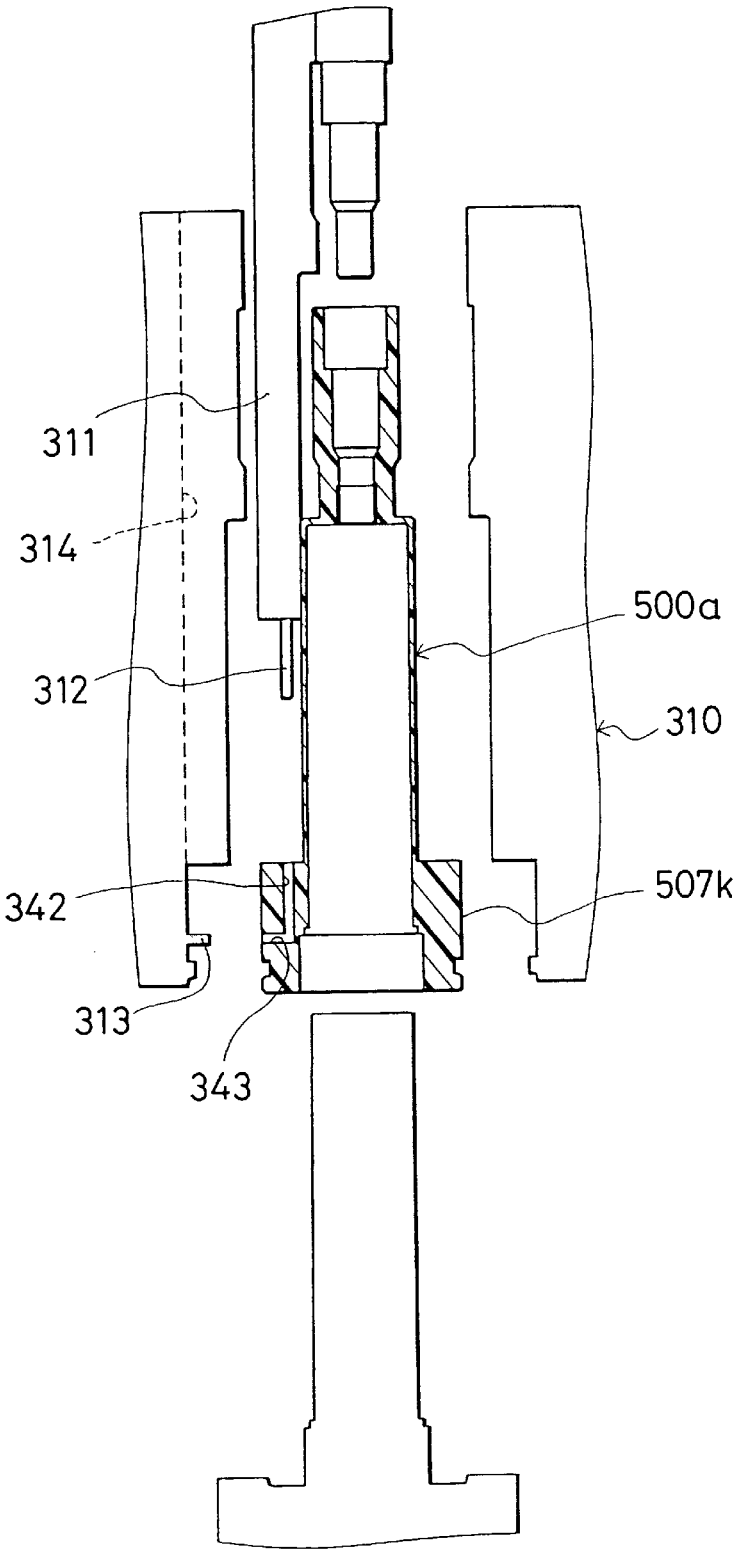
FIG. 14 is a partially sectional view of a second embodiment of a die for molding a casing of the ignition coil in the fifth embodiment of the present invention.

Another example of a die 310 for molding a casing 500*a* in the fifth embodiment is shown in FIG. 14. An arm portion 311 is provided on the die 310. An axial blind hole 342 is formed by a stick portion 312 provided on the top of the arm portion 311. The radial hole 343 is formed by a stick portion 313 provided on the die 310. A recess portion 314 is provided on the die 310 to keep a sliding space on the arm portion 311. According to the die 310, a head passage which consists of the axial hole 342 and the radial hole 343 can be formed while molding the casing 500*a* even when the axial hole 342 does not penetrate a head portion 507*k*.

(Sixth embodiment)

Figure 10:
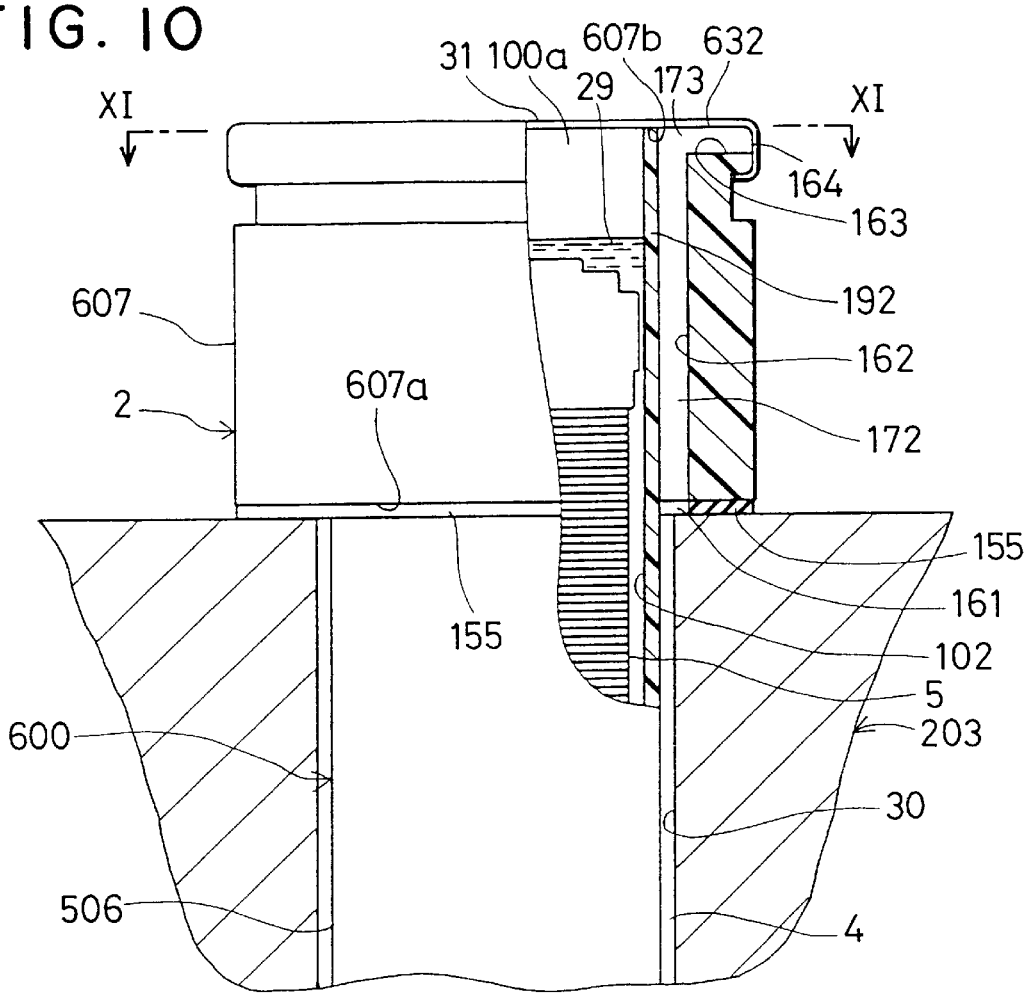
FIG. 10 is a partially sectional view of an ignition coil according to a sixth embodiment of the present invention.
Figure 11:
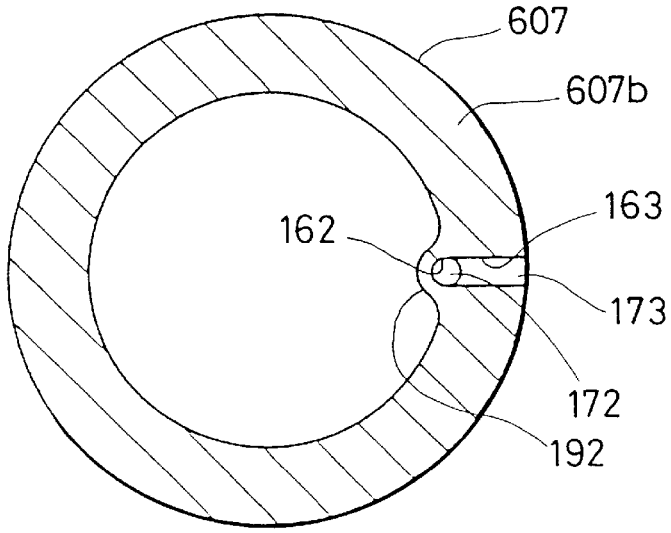
FIG. 11 is a schematic cross sectional view taken along the line XI—XI of FIG. 10.

A sixth embodiment of the present invention is shown in FIGS. 10 and 11. As shown in FIG. 11, a thick portion 192 has a portion which extends inside of a head portion 607. The thick portion 192 is provided from an upper surface 607*b* to a lower surface 607*a* of the head portion 607 along the axial direction of the head portion 607.

As shown in FIG. 10, an axial hole 162, which is formed from the upper surface 607*b* to the lower surface 607*a* of the head portion 607 inside of the packing 155 along the axial direction of the head portion 607, penetrates the thick portion 192 in axial direction of the head portion 607. An axial passage 172, which is connected to a first gap 161, is defined by the axial hole 162. A radial groove 163, which connects the axial hole 162 to an opening on the peripheral edge of the top of the head portion 607 inside of the cap 31, is formed on the upper surface 607*b* along the radial direction of the head portion 607. The cap is curled and caulked on the head portion 607. Upper edges of the radial groove 163 and the axial hole 162 are closed by a seal 632 in order to define a radial passage 173 between the radial groove 163 and the seal 632.

The radial passage 173 is connected to the axial passage 172 and a ring-shaped second gap 164 which is formed between the cap 31 and the top periphery of the head portion 607. The second gap 164 is connected to the space of the engine compartment through the small gap (not shown) between the peripheral edge of the cap 31 and the outer wall of the head portion 607 formed when the edge of the metal cap 31 is curled and caulked on the head portion 607. Therefore, the plug hole 4 is connected to the space of the engine compartment through a connecting passage which consists of the first gap 161, the axial passage 172, the second gap 164 and the radial passage 173.

According to the sixth embodiment of the present invention, in addition to the same effects and advantages as the fifth embodiment, there is an advantage that it becomes more difficult than the fifth embodiment for water to enter into the plug hole 4 through the connecting passage which consists of the first gap 161, the axial passage 172, the radial passage 173 and the second gap 164 when water falls on the head cover 203 of the engine, because the connecting passage can be formed at a higher position than the upper surface of the head cover 203 and the radial groove 163 has the opening inside the cap 31. Furthermore, the outer diameter of the head portion 607 can be reduced from that in the fifth embodiment because the axial hole 162 is formed on inner position by providing the thick portion 192. Therefore, the ignition coil 2 can be downsized.

It may be possible to adopt the thick portion 192 and the axial hole 162 to the fifth embodiment. According to such adoption, the outer diameter of the head portion 507 can be reduced.

It may be possible to adopt the radial passage 173 on the upper edge of the head portion 607 and the connecting structure to the space of the engine compartment including the second gap 164 to the fifth embodiment. According to such adoption, it becomes more difficult for water to enter into the plug hole 4 through the connecting passage when water falls on the head cover 203 of the engine.

It may be possible to provide an opening hole on the side periphery wall of the cap 31 for connecting the second gap 164 to the space of the engine compartment instead of the small gap between the peripheral edge of the cap 31 and the outer wall of the head portion 607 formed when the edge of the metal cap 31 is curled and caulked on the head portion 607. Furthermore, it may be possible to provide a notch on the side periphery wall extended to the peripheral edge of the cap 31. According to the notch, the passage of air between the second gap 164 and the engine compartment can be improved.

(Seventh embodiment)

Figure 12:
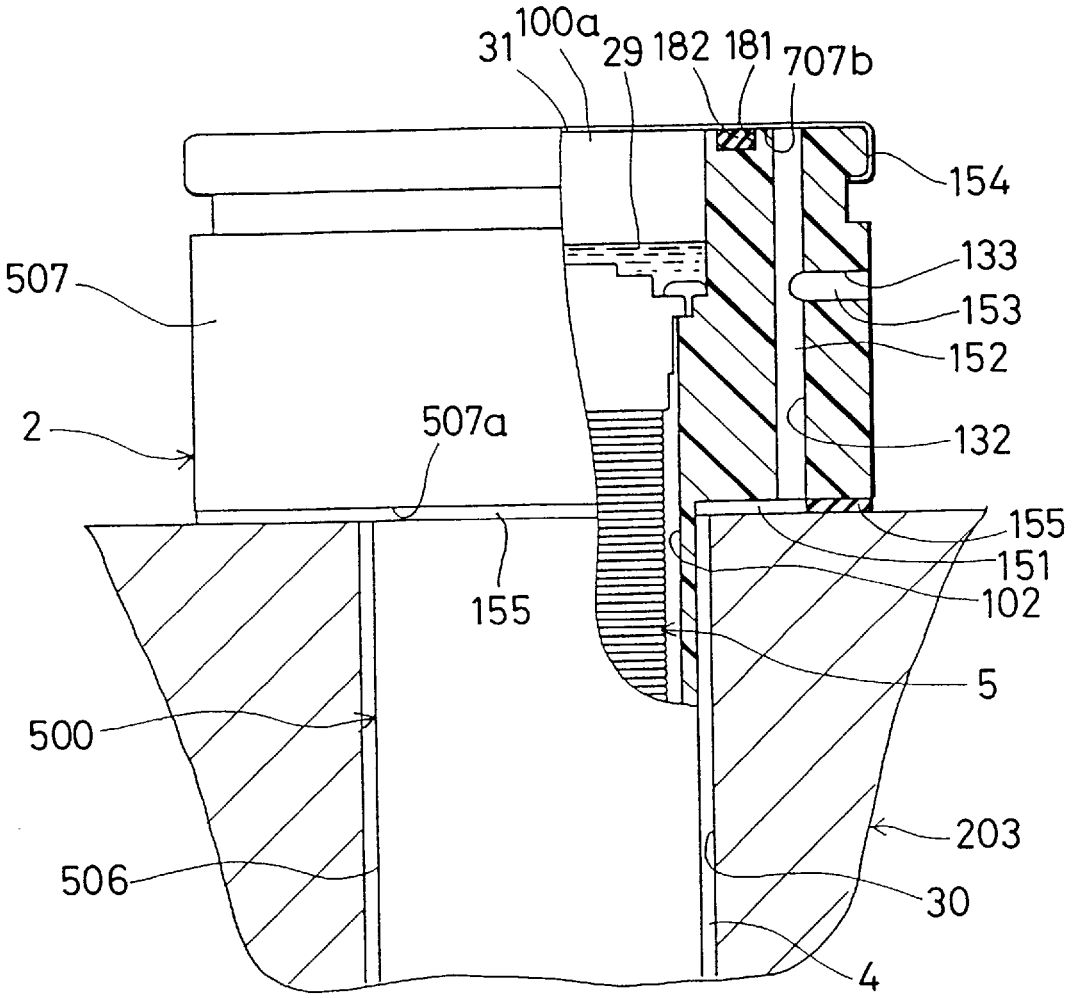
FIG. 12 is a partially sectional view of an ignition coil according to a seventh embodiment of the present invention.

A seventh embodiment of the present invention is shown in FIG. 12. In the seventh embodiment, an O-ring 182 is provided instead of the seal 32 in the fifth embodiment. A ring shape recess 181 is formed on an upper surface 707*b* at an inner place than the axial hole 132. The O-ring 182 is fitted into the recess 181. Therefore, the seal between the opening 100*a* and the axial passage 152 can be achieved by the O-ring 182.

According to the seventh embodiment, the positioning of the O-ring 182 may be easier than the seal 32 in the fifth embodiment, and selecting appropriate parameters for O-ring 182, such as thickness, hardness, materials or the like, may be easier in view of the familiarity of those of ordinary skill in the art with O-rings.

According to the first through seventh embodiment of the present invention, the connecting passage which connects the plug hole to the atmospheric pressure in the engine compartment can be formed by simple molding, regardless of the angle of the attachment of the ignition coil because the pipe portion in the plug hole and the head portion outside of the plug hole are integrally molded by resin. Furthermore, the shape of the packing between the ignition coil and the head cover of the engine can be simplified and the positioning of the packing against the ignition coil is not necessary, because the groove, gaps and holes of the connecting passage are formed on the casing only. Therefore, the possibility of water entering into the ignition coil caused by the shifting of the packing can be reduced.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An ignition coil for an internal combustion engine having a plug hole comprising:

a casing having a head portion and a pipe portion, said head portion being adapted to be disposed outside said plug hole, said pipe portion being adapted to be disposed in said plug hole;

a seal having a generally ring shape provided on said head portion and adapted to seal against said combustion engine, said seal and an outer periphery of said pipe portion defining a gap therebetween; and a head passage being provided on said head portion and connected to said gap and extending outside of said head portion.

2. An ignition coil according to claim 1, wherein:

said pipe portion further includes a gap forming portion extending from said outer periphery of said pipe portion; and said gap is determined by said gap forming portion and an inner periphery of said seal.

3. An ignition coil according to claim 2, wherein said head passage further includes a groove formed on a part of said head portion where said head portion is sealed by said seal.

4. An ignition coil according to claim 3, wherein said seal further includes an axial seal portion which seals against said gap forming portion and which is adapted to seal against said plug hole in the axial direction of said pipe portion.

5. An ignition coil according to claim 1, wherein said head passage further includes an axial passage which is connected to said gap and a radial passage which connects said axial passage and extends outside of said head portion.

6. An ignition coil according to claim 5, wherein:

said head portion further includes a cap, which defines a second gap between said head portion and said cap, on a top portion of said head portion; and said head passage is connected to said outside of said head portion through said second gap.

7. An ignition coil according to claim 2, wherein said seal further includes an axial seal portion which seals between said gap forming portion and which is adapted to seal against said plug hole in an axial direction of said pipe portion.

8. An ignition coil for an internal combustion engine having a plug hole comprising:

a casing having a head portion and a pipe portion, said head portion being adapted to be disposed outside said plug hole, said pipe portion being adapted to be disposed in said plug hole;

a first passage being provided on an outer periphery of said pipe portion and having an opening outside of said pipe portion; and a second passage being provided on said head portion and connecting said first passage and an outside of said head portion.

9. An ignition coil according to claim 8, wherein said first passage is formed in an axial direction of said pipe portion, and said second passage is formed in a radial direction of said pipe portion.

10. An ignition coil according to claim 9, further comprising a seal attached to said ignition coil and adapted to seal any gap between said ignition coil and said engine other than said first passage and second passage.

11. An ignition coil according to claim 10, wherein said second passage further includes a groove formed on a lowest part of said head portion.

* * * * *